US006663503B1

(12) United States Patent
Kenmi

(10) Patent No.: US 6,663,503 B1
(45) Date of Patent: Dec. 16, 2003

(54) GOLF CLUB HEAD AND GOLF CLUB EQUIPPED WITH SAID GOLF CLUB HEAD

(75) Inventor: Yoshinari Kenmi, Kobeshi (JP)

(73) Assignee: Royal Collection, Inc., Hyogo (JP)

( * ) Notice: Subject to any disclaimer, the term of this patent is extended or adjusted under 35 U.S.C. 154(b) by 0 days.

(21) Appl. No.: 10/152,991

(22) Filed: May 23, 2002

(51) Int. Cl.[7] ..... A63B 53/04
(52) U.S. Cl. ..... 473/328; 473/345; 473/349
(58) Field of Search ..... 473/324, 345, 473/327, 328, 346, 349

(56) References Cited

U.S. PATENT DOCUMENTS 2,041,676 A * 5/1936 Gallagher
5,257,786 A * 11/1993 Gorman
D344,998 S * 3/1994 Greene
5,380,009 A * 1/1995 Henry
D361,356 S * 8/1995 Feche
5,441,263 A * 8/1995 Gorman
D363,749 S * 10/1995 Kenmi
5,456,469 A * 10/1995 MacDougall
5,467,988 A * 11/1995 Henwood
5,643,107 A * 7/1997 Gorman
5,735,754 A * 4/1998 Antonious
6,027,416 A * 2/2000 Schmidt
6,123,627 A * 9/2000 Antonious ..... 473/327
D442,244 S * 5/2001 Olsavsky

FOREIGN PATENT DOCUMENTS

JP 2831585 6/1996

* cited by examiner

*Primary Examiner*—Sebastiano Passaniti
(74) *Attorney, Agent, or Firm*—Rothwell, Figg, Ernst & Manbeck; Stephen B. Parker

(57) ABSTRACT

A metallic hollow golf club head includes a sole face gently downwardly curved from a heel portion toward a toe portion, a generally rectangular protrusion having a predetermined width, the protrusion being downwardly protruded from an intermediate region of the sole face between the heel portion and the toe portion and extending backward from a face, and a recess formed at a widthwise-central portion of the protrusion and extending backward straightly with a predetermined width from a position apart from the face by a predetermined distance, thereby forming a pair of parallel rail portions at both sides of the recess. The recess is opened at a back face.

33 Claims, 3 Drawing Sheets

GOLF CLUB HEAD AND GOLF CLUB EQUIPPED WITH SAID GOLF CLUB HEAD

BACKGROUND OF THE INVENTION

1. Field of the Invention

The present invention relates to a golf club head of a metal shell structure and a golf club equipped with the golf club head.

2. Description of Related Art

The so-called wood-type golf club head having a wider sweet spot and capable of obtaining a straight and longer drive without causing a slice or a hook has been desired.

To cope with this request, the present applicant proposed a golf club head of a metal shell structure through Japanese Patent No. 2831585. This golf club head is provided with a recess formed at a widthwise-central portion of the sole and extending backward from a position apart from the face. The recess is opened at the back face.

The present invention is directed to an improvement of the aforementioned golf club head.

It is an object of the present invention to provide a golf club head and a golf club equipped with the golf club head with a larger sweet spot and a lower center of gravity, which enables a straight and longer drive.

It is another object of the present invention to provide a golf club head and a golf club equipped with the golf club head capable of reducing friction between the golf club head and a ground and guiding the golf cub head straight along the direction of hitting a ball even in cases where the sole of the golf club head comes into contact with the ground during the swing.

SUMMARY OF THE INVENTION

According to the first aspect of the present invention, a golf club head of a metal shell structure includes a sole face gently downwardly curved from a heel portion toward a toe portion, a generally rectangular protrusion having a predetermined width, the protrusion being downwardly protruded from an intermediate region of the sole face between the heel portion and the toe portion and extending backward from a face, and a recess formed at a widthwise-central portion of the protrusion and extending backward straightly with a predetermined width from a position apart from the face by a predetermined distance, thereby forming a pair of parallel rail portions at both sides of the recess, the recess being opened at a back face.

According to this structure, the depth of the center of gravity of the golf club head increases because of the weight of the side walls constituting the recess, resulting in an enlarged sweet spot. Accordingly, the hit probability within the sweet spot can be increased, which in turn enables an intended straight driving. Furthermore, the protrusion formed on the sole surface lowers the center of gravity, resulting in a higher ballistic course and an increased carry. Furthermore, since a pair of parallel rail portions are formed at both sides of the recess, the friction between the golf club head and a ground can be reduced and the golf club head can be guided straight along the direction of hitting a ball even in cases where the sole of the golf club head comes into contact with the ground during the swing.

It is preferable that each of the rail portions is provided with a straight guide groove at a widthwise-central portion thereof. This straight guide groove further enhances the aforementioned straight driving, which further stabilizes a swing.

It is preferable that the protrusion is formed at a region having a width of about ½ to about ¼ of a length from the heel portion to the toe portion.

It is preferable that a face-side tip portion of the recess is formed into a semicircular shape.

It is preferable that the recess includes a front straight portion having a generally constant width and a rear opening portion continued from the front straight portion and that the rear opening portion gradually increases in width toward a back face and has a rear end opened at the back face.

It is preferable that the front straight portion has a length falling within the range of from 10 to 40 mm, more preferably from 20 mm to 35 mm, a width falling within the range of from 8 to 20 mm, more preferably from 10 to 15 mm, and a depth falling within the range of from 3 mm to ½ of a head height, more preferably 5 mm to 15 mm.

According to the another aspect of the present invention, a golf club is provided with a golf club head of a metal shell structure which includes a sole face gently downwardly curved from a heel portion toward a toe portion, a generally rectangular protrusion having a predetermined width, the protrusion being downwardly protruded from an intermediate region of the sole face between the heel portion and the toe portion and extending backward from a face, and a recess formed at a widthwise-central portion of the protrusion and extending backward straightly with a predetermined width from a position apart from the face by a predetermined distance, thereby forming a pair of parallel rail portions at both sides of the recess, the recess being opened at a back face.

Other objects and the features of the present invention will be apparent from the following detailed description of the present invention with reference to the attached drawings.

BRIEF DESCRIPTION OF THE DRAWINGS

The present invention will be more fully described and better understood from the following description, taken with the appended drawings, in which.

DETAILED DESCRIPTION OF THE PREFERRED EMBODIMENTS

Figure 1:
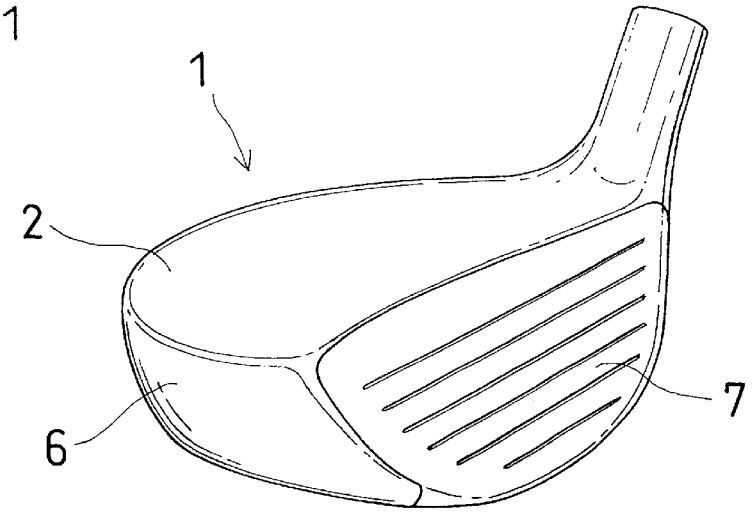
FIG. 1 is a perspective view of a golf club head according to an embodiment of the present invention.

A preferable embodiment of the present invention will be explained with reference to the drawings.

The wood-type golf club head 1 shown in FIGS. 1 to 7 is the so-called metal wood-type golf club head. The reference numeral 2 denotes a metal head shell, and 3 denotes a filler. The head shell 2 is a molded article made of metals such as stainless steel, aluminum, titanium and magnesium. The filler 3 is formed by filling materials having a specific gravity lighter than that of the shell 2, e.g., foaming resin materials such as rigid urethane foam, in the shell 2 by a conventional method.

Figure 2:
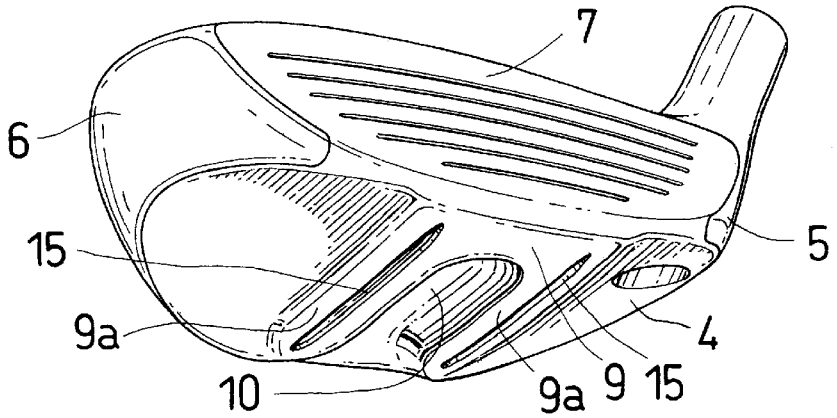
FIG. 2 is a perspective view of the golf club head seen from the front slantwise lower side.
Figure 3:
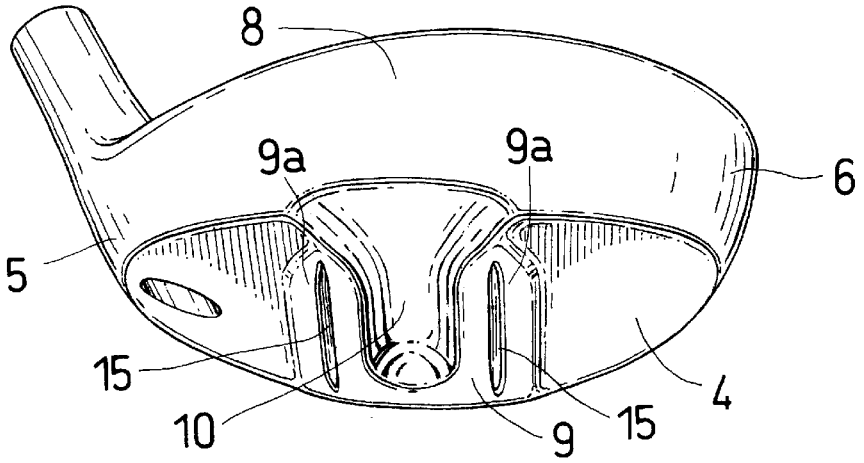
FIG. 3 is a perspective view of the golf club head seen from the rear lower side.
Figure 4:
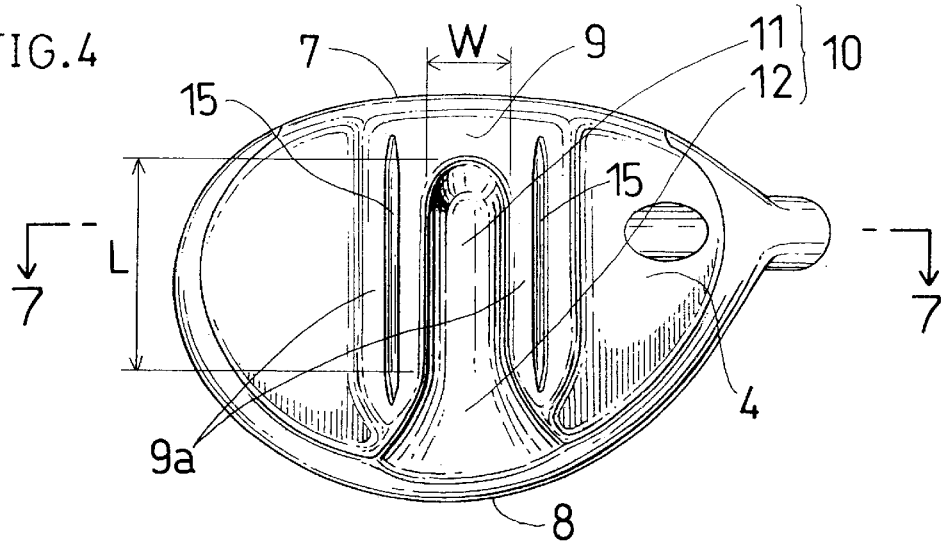
FIG. 4 is a bottom view of the golf club head.
Figure 5:
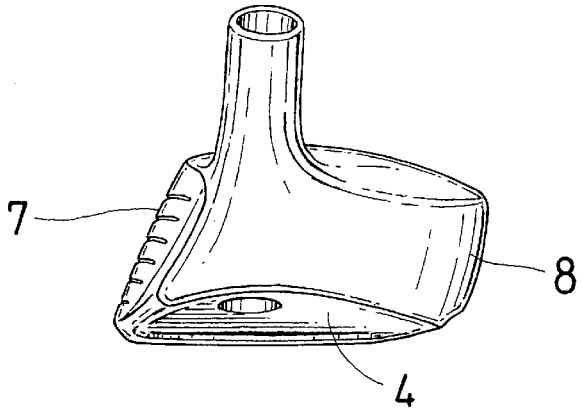
FIG. 5 is a side view of the golf club head seen from the heel side.
Figure 6:
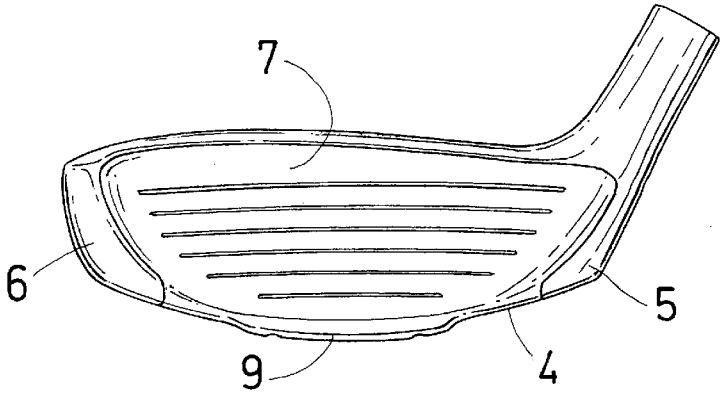
FIG. 6 is a front view of the golf club head.

As clearly shown especially in FIG. 6, the sole surface 4 of the golf club head 1 is gently downwardly curved from a heel portion 5 toward a toe portion 6. As shown in FIG. 2, at the widthwise-central portion of the sole surface 4, i.e., a central region between the heel portion 5 and the toe portion 6, a generally rectangular protrusion 9 having a predetermined width is downwardly protruded so as to extend backward from the face 7.

Because of the existence of this protrusion 9, the head 1 has a low-center-of-gravity structure, which enables a higher ballistic course and an increased carry. Furthermore, even if the sole 4 of the golf club head 1 comes into contact with a ground during the swing, the contact area between the sole 4 and the ground can be decreased because of the aforementioned configuration of the sole surface 4 and the existence of the protrusion 9. Accordingly, even in cases where the head comes into contact with a ground by a misshot or an intentional shot, a user can swing at a ball smoothly. This protrusion 9 is formed at a region having a width of about ½ to about ¼ of a length from the heel portion 5 to the toe portion 6. If the width comes off the aforementioned upper or lower limit, the functions and effects, which will be detailed later, cannot be obtained.

Now, if the depth of the center of gravity of the golf club head 1, which is the distance from the face 7 to the center of gravity, is increased, the sweet spot becomes larger. To utilize this characteristic, in the golf club head 1 according to this embodiment, a recess 10 is formed at a widthwise-central portion of the protrusion 9 so as to extend backward straightly with a predetermined width from a position apart from the shell wall constituting the face 7 by a predetermined distance. The recess 10 is opened at the back face 8.

In detail, the recess 10 is formed at a widthwise-central portion of the protrusion 9 so as to extend backward straightly with a predetermined width from a position apart from the face 7 by a predetermined distance and open at a back face 8. As clearly shown in FIG. 4, this recess 10 extends backward from the position apart from the rear surface of the shell wall constituting the face 7 and opens at the back face 8.

The front part of this recess 10 is formed into a parallel portion (front straight portion) 11 with a constant width W or an approximate constant width, and the rear part thereof is formed into a rear width-increasing opening portion (rear opening portion) 12 continued from the parallel portion 11 and gradually increased in width toward the back face 8. The face-side tip portion of the parallel portion 11 is formed into a semicircular shape, and the bottom of the parallel portion 11 is formed into a round cross-sectional shape as shown in FIG. 7.

As mentioned above, since the recess 10 is formed at the protrusion 9, a pair of parallel rail portions 9*a* and 9*a* are formed at both sides of the recess 10.

Figure 7:
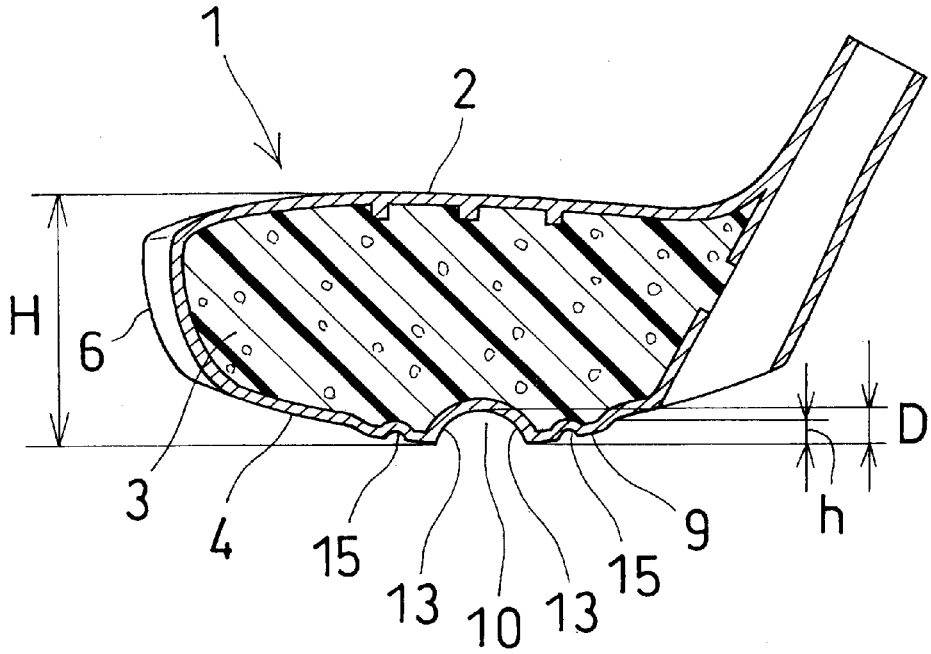
FIG. 7 is a cross-sectional view taken along the line 7—7 in FIG. 4.

By forming the protrusion 9 at the sole 4 of the metal wood head 1 of a metal shell structure, as shown in FIG. 7, upright metal shell walls 13 and 13 are formed at both sides of the recess 10. Accordingly, because of the weight of these shell walls 13 and 13, the depth of the center of gravity of the head 1 can be increased and a structure having a low center of gravity can be realized.

In this golf club head 1, since the recess 10 is formed at a widthwise-central portion of the protrusion 9 so as to extend backward straightly with a predetermined width from a position apart from the face 7 by a predetermined distance and open at the back face 8, as mentioned above, the depth of the center of gravity of the head 1 is increased because of the weight of the shell walls 13 and 13 at both sides of the recess 10, and the sweet spot is also increased. Accordingly, the hit probability within the sweet spot can be increased, which in turn enables an intended straight driving with no slice or hook.

Furthermore, the existence of the shell walls 13 and 13 at both sides of the recess 10 and the existence of the protrusion 9 formed on the sole surface 4 have combined to make the center of gravity lower, resulting in a higher ballistic course and a further increased carry.

Furthermore, since the recess 10 has the rear opening portion 12 gradually increased in width toward the back face 8, the existence of the shell walls 13 and 13 of the rear opening portion 12 makes the depth of the center of gravity larger and the center of gravity lower. Especially, since the recess 10 is formed to have the front straight portion 11 at the front side, i.e., the face side, the shell walls 13 and 13 thereof are arranged along the fore-and-aft direction. Accordingly, both the shell walls 13 and 13 convey the impact energy to a ball intensively and explosively at the time of hitting a ball. Accordingly the so-called hammer effect can be obtained, which further increases the carry. Furthermore, since both the side walls 13 and 13 of the front straight portion 11 are spaced apart from each other and located at the position apart from the rear surface of the shell wall constituting the face 7, a driving can be stabilized.

As mentioned above, the sole surface 4 is gently downwardly curved from the heel portion 5 to the toe portion 6, and the protrusion 9 is formed at the sole surface 4. Furthermore the recess 10 is formed at the protrusion 9 so as to open at the back face 8, thereby forming a pair of parallel rail portions 9*a* and 9*a*. Accordingly, even in cases where the sole 4 of the head 1 comes into contact with a ground, a user can swing at a ball smoothly because of the reduced resistance between the head 1 and the ground due to the existence of the protrusion 9, the recess 10 and the rear opening portion 12 of the recess 10. Furthermore, since the recess 10 has the straight portion 11, when the sole surface 4 comes into contact with a ground during the swing, the straight portion 11 guides the head 1 straight. Accordingly, even in cases where the sole surface 4 comes into contact with a ground during a swing, a user can hit a ball straight and farther. This function will be further enhanced by the pair of parallel rail portions 9*a* and 9*a* of the protrusion 9, and therefore the hitting straightness and the driving stability can be further enhanced.

Furthermore, since this recess 10 has the rear opening portion 12 gradually increased in width backward, an intentional swing can be performed smoothly, and therefore the exquisite shot using advanced golf technique can be realized smoothly.

It is preferable that the height h of the protrusion 9 from the sole surface 4 (see FIG. 7) falls within the range of from 1 mm to 5 mm. If the height h is less than 1 mm, it becomes difficult to expect that the reduction effect of the resistance between the head 1 and a ground when the head 1 comes into contact with the ground during the swing. To the contrary, if the height h exceeds 5 mm, the center of gravity rises, which tends to decrease the high ballistic effect due to the low center of gravity and the ground contact stability during the stance and also tends to cause the change of loft and the instability of setting. Accordingly, it is more preferable that the height h of the protrusion 9 from the sole surface 4 falls within the range of from 1.5 mm to 4.0 mm.

It is preferable that the front straight portion 11 has a length L (see FIG. 4) falling within the range of from 10 to 40 mm, a width W (see FIG. 4) falling within the range of from 8 to 20 mm and a depth D (see FIG. 7) falling within the range of from 3 mm to ½ of a head height.

If the length L of the front straight portion 11 is less than 10 mm, the hammer effect tends to decrease. If the length L exceeds 40 mm, the rear opening portion 12 becomes too short, which makes an intentional swing difficult. Accordingly, it is more preferable that the length of the front straight portion 11 falls within the range of from 20 to 35 mm.

If the width W of the front straight portion 11 becomes smaller than 8 mm, the possibility of stagnation of an object in the portion 11 becomes higher and/or the instability of driving due to the hammer effect may increase. To the contrary, if the width W of the front straight portion 11 exceeds 20 mm, the bottom shell wall constituting the straight portion 11 becomes large, the center of gravity rises, which tends to decrease the high ballistic effect due to the low center of gravity and the ground contact stability during the stance and also cause the change of loft and the instability of setting. Accordingly, it is more preferable that the width W of the front straight portion 11 falls within the range of from 10 mm to 15 mm.

If the depth D of the front straight portion 11 is less than 3 mm, the weight increase effects due to the side walls 13 and 13 constituting the recess 10 become insufficient, which tends to become difficult to enlarge the range of sweet spot caused by the increased depth of center of gravity and obtain the effects due to the lower center of gravity. If the depth D exceeds ½ of the head height, it becomes difficult to obtain the effects due to the lower center of gravity. Accordingly, it is more preferable that the depth of the front straight portion 11 falls within the range of from 5 mm to 15 mm.

In order to further enhance the functions and effects of the aforementioned recess 10 and those of the aforementioned pair of rail portions 9*a* and 9*a*, a guide groove 15 is formed at a widthwise-central portion of each of the rail portions 9*a* and 9*a* so as to extend straight. In order to exhibit these functions and effects, it is preferable that the guide groove 15 has a width falling within the range of from 1.5 mm to 3.0 mm and a depth falling within the range of from 0.5 mm to 2.0 mm. The existence of the guide rail 15 can further lower the center of gravity of the head 1, decrease the resistance between the sole and a ground when the head 1 comes into contact with the ground and enhance the straight guidance of the head 1.

In this embodiment, in order to realize the most suitable head structure, the dimensions are set as follows: the height h of the protrusion 9 from the sole surface 4 is 2.5 mm; the depth D of the recess 10 is about 7 mm; the width W of the straight portion 11 of the recess 10 is about 13 mm and the length L of the straight portion 11 of the recess 10 is 30 mm; and the width and the depth of the guide groove 15 are 2.0 mm and 1.5 mm, respectively.

Figure 8:
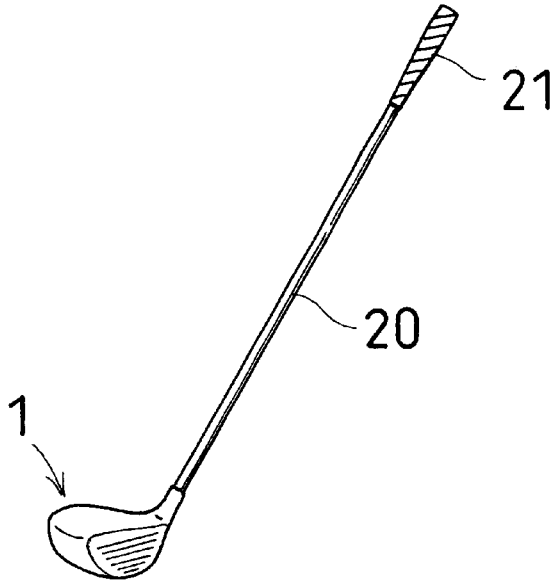
FIG. 8 is a golf club equipped with the aforementioned golf club head.

FIG. 8 illustrates a golf club equipped with the aforementioned golf club head 1. The reference numeral 20 denotes a shaft, and 21 denotes a grip.

The terms and descriptions in this specification are used only for explanatory purposes and the present invention is not limited to these terms and descriptions. It should be appreciated that there are many modifications and substitutions without departing from the spirit and the scope of the present invention which is defined by the appended claims. The present invention permits any design-change, unless it deviates from the soul, if it is within the limits by which the claim was performed.

What is claimed is:

1. A golf club head of a metal shell structure, comprising:

a sole face gently downwardly curved from a heel portion toward a toe portion;

a generally rectangular protrusion having a predetermined width, said protrusion being downwardly protruded from an intermediate region of said sole face between said heel portion and said toe portion and extending backward from a face; and a recess formed at a widthwise-central portion of said protrusion and extending backward straightly with a predetermined width from a position apart from said face by a predetermined distance, thereby forming a pair of parallel rail portions at both sides of said recess, said recess being opened at a back face.

2. The golf club head as recited in claim 1, wherein each of said rail portions is provided with a straight guide groove at a widthwise-central portion thereof.

3. The golf club head as recited in claim 2, wherein said guide groove has a width falling within the range of from 1.5 mm to 3.0 mm and a depth falling within the range of from 0.5 mm to 2.0 mm.

4. The golf club head as recited in claim 1, wherein said protrusion is formed at a region having a width of about ½ to about ¼ of a length from said heel portion to said toe portion.

5. The golf club head as recited in claim 1, wherein said recess has a face-side tip portion having a semicircular shape.

6. The golf club head as recited in claim 1, wherein said recess includes a front straight portion having a generally constant width and a rear opening portion continued from said front straight portion, and wherein said rear opening portion gradually increases in width toward a back face and has a rear end opened at said back face.

7. The golf club head as recited in claim 1, wherein said front straight portion has a length falling within the range of from 10 to 40 mm, a width falling within the range of from 8 to 20 mm and a depth falling within the range of from 3 mm to ½ of a head height.

8. The golf club head as recited in claim 7, wherein said length of said front straight portion falls within the range of from 20 to 35 mm.

9. The golf club head as recited in claim 7, wherein said width of said front straight portion falls within the range of from 10 to 15 mm.

10. The golf club head as recited in claim 7, wherein said depth of said front straight portion falls within the range of from 5 to 15 mm.

11. The golf club head as recited in claim 1, wherein a weight of said protrusion lowers a center of gravity of said golf club head.

12. The golf club head as recited in claim 11, wherein said head includes a metal shell with a filler having a specific gravity lighter than that of the shell.

13. The golf club head as recited in claim 1, wherein said recess increases a depth of a center of gravity of the golf club head.

14. The golf club head as recited in claim 13, wherein a weight of side walls of said recess increases said depth of said center of gravity.

15. The golf club head as recited in claim 13, wherein said head includes a metal shell with a filler having a specific gravity lighter than that of the shell.

16. The golf club head as recited in claim 1, wherein said protrusion is of a means for lowering a center of gravity of said golf club head and said recess is of a means for increasing a depth of the center of gravity of the golf club head.

17. A golf club head of a metal shell structure, comprising:

a sole face gently downwardly curved from a heel portion toward a toe portion;

a generally rectangular protrusion having a predetermined width, said protrusion being downwardly protruded from an intermediate region of said sole face between said heel portion and said toe portion and extending backward from a face;

a recess formed at a widthwise-central portion of said protrusion and extending backward straightly with a predetermined width from a position apart from said face by a predetermined distance, thereby forming a pair of parallel rail portions at both sides of said recess, said recess being opened at a back face; and a straight guide groove formed at a widthwise-central portion of each of said rail portions, wherein said protrusion is formed at a region having a width of about ½ to about ½ of a length from said heel portion to said toe portion, wherein said recess includes a front straight portion having a generally constant width and a rear opening portion continued from said front straight portion, and wherein said rear opening portion gradually increases in width toward a back face and has a rear end opened at said back face, wherein said front straight portion has a length falling within the range of from 10 to 40 mm, a width falling within the range of from 8 to 20 mm and a depth falling within the range of from 3 mm to ½ of a head height, and wherein said guide groove has a width falling within the range of from 1.5 mm to 3.0 mm and a depth falling within the range of from 0.5 mm to 2.0 mm.

18. A golf club with a golf club head of a metal shell structure, said golf club head comprising:

a sole face gently downwardly curved from a heel portion toward a toe portion;

a generally rectangular protrusion having a predetermined width, said protrusion being downwardly protruded from an intermediate region of said sole face between said heel portion and said toe portion and extending backward from a face; and a recess formed at a widthwise-central portion of said protrusion and extending backward straightly with a predetermined width from a position apart from said face by a predetermined distance, thereby forming a pair of parallel rail portions at both sides of said recess, said recess being opened at a back face.

19. The golf club as recited in claim 18, wherein each of said rail portions is provided with a straight guide groove at a widthwise-central portion thereof.

20. The golf club as recited in claim 19, wherein said guide groove has a width falling within the range of from 1.5 mm to 3.0 mm and a depth falling within the range of from 0.5 mm to 2.0 mm.

21. The golf club as recited in claim 18, wherein said protrusion is formed at a region having a width of about ½ to about ½ of a length from said heel portion to said toe portion.

22. The golf club as recited in claim 18, wherein said recess has a face-side tip portion having a semicircular shape.

23. The golf club as recited in claim 18, wherein said recess includes a front straight portion having a generally constant width and a rear opening portion continued from said front straight portion, and wherein said rear opening portion gradually increases in width toward a back face and has a rear end opened at said back face.

24. The golf club as recited in claim 18, wherein said front straight portion has a length falling within the range of from 10 to 40 mm, a width falling within the range of from 8 to 20 mm and a depth falling within the range of from 3 mm to ½ of a head height.

25. The golf club as recited in claim 24, wherein said length of said front straight portion falls within the range of from 20 to 35 mm.

26. The golf club as recited in claim 24, wherein said width of said front straight portion falls within the range of from 10 to 15 mm.

27. The golf club as recited in claim 24, wherein said depth of said front straight portion falls within the range of from 5 to 15 mm.

28. A golf club as recited in claim 18, wherein a weight of said protrusion lowers a center of gravity of said golf club head.

29. The golf club as recited in claim 28, wherein said head includes a metal shell with a filler having a specific gravity lighter than that of the shell.

30. The golf club as recited in claim 18, wherein said recess increases a depth of a center of gravity of the golf club head.

31. The golf club as recited in claim 30, wherein a weight of side walls of said recess increases said depth of said center of gravity.

32. The golf club as recited in claim 30, wherein said head includes a metal shell with a filler having a specific gravity lighter than that of the shell.

33. The golf club head as recited in claim 18, wherein said protrusion is of a means for lowering a center of gravity of said golf club head and said recess is of a means for increasing a depth of the center of gravity of the golf club head.

* * * * *

UNITED STATES PATENT AND TRADEMARK OFFICE

CERTIFICATE OF CORRECTION

PATENT NO. : 6,663,503 B1
DATED : December 16, 2003
INVENTOR(S) : Kenmi

It is certified that error appears in the above-identified patent and that said Letters Patent is hereby corrected as shown below:

Column 8,
Line 7, "1/2" should be -- 1/4 --

Signed and Sealed this

Twenty-second Day of June, 2004

JON W. DUDAS
*Acting Director of the United States Patent and Trademark Office*